US008006748B2

(12) United States Patent
Modi et al.

(10) Patent No.: US 8,006,748 B2
(45) Date of Patent: Aug. 30, 2011

(54) SEALING ARRANGEMENT FOR INTERNAL TUBESHEET FOR TUBULAR HEAT EXCHANGERS

(75) Inventors: Anil Kumar Modi, Maharashtra (IN); Veeravali Ramesh Nembilli, Maharashtra (IN); Venkatesh Murur, Maharashtra (IN)

(73) Assignee: Larsen & Toubro Limited (IN)

( * ) Notice: Subject to any disclaimer, the term of this patent is extended or adjusted under 35 U.S.C. 154(b) by 122 days.

(21) Appl. No.: 12/298,009

(22) PCT Filed: Apr. 20, 2007

(86) PCT No.: PCT/IN2007/000154

§ 371 (c)(1),
(2), (4) Date: Dec. 18, 2008

(87) PCT Pub. No.: WO2007/122631

PCT Pub. Date: Nov. 1, 2007

(65) Prior Publication Data

US 2009/0095453 A1 Apr. 16, 2009

(30) Foreign Application Priority Data

Apr. 21, 2006 (IN) ..... 628/MUM/2006

(51) Int. Cl.
*F28F 9/02* (2006.01)

(52) U.S. Cl. ..... 165/158

(58) Field of Classification Search ..... 165/158
See application file for complete search history.

(56) References Cited

U.S. PATENT DOCUMENTS

| | | | | | |
|---|---|---|---|---|---|
| 2,296,710 | A | * | 9/1942 | Fischer | 165/158 |
| 2,340,756 | A | | 2/1944 | Jacocks | |
| 2,956,704 | A | | 10/1960 | Boni, Jr. | |
| 4,630,673 | A | * | 12/1986 | Belleli | 165/158 |
| 4,750,554 | A | | 6/1988 | Oeij | |
| 5,755,277 | A | * | 5/1998 | Appel et al. | 165/158 |
| 5,984,001 | A | * | 11/1999 | Welkey | 165/158 |

FOREIGN PATENT DOCUMENTS

| | | | | | |
|---|---|---|---|---|---|
| EP | 0097324 | A2 | | 4/1984 | |
| EP | 0614064 | A2 | | 7/1994 | |
| GB | 2041191 | A | | 9/1980 | |
| JP | 61031894 | A | * | 2/1986 | 165/158 |
| NL | 8300397 | A | | 9/1984 | |

* cited by examiner

*Primary Examiner* — Leonard R Leo
(74) *Attorney, Agent, or Firm* — Brooks Kushman P.C.

(57) ABSTRACT

Sealing arrangement for an internal tubesheet for tubular heat exchangers comprising, a gasket fitted between a shoulder and a tubesheet, the gasket being made of spiral wound construction but without any metallic rings and without any locating groove in the adjoining components. On the outer side of the tubesheet, a channel box is provided with its inner face resting on a shoulder provided on an outer diameter of the tubesheet while the outer face of the channel box is reduced in diameter and arranged to align with the centerline of the push bolts, the outer face of the channel box resting against and attached to an annular ring and the push bolts being provided in threaded holes that reach up to the outer face of an internal flange. The push bolts, when tightened, load the annular ring, which in turn loads the gasketed joint through the channel box and the tubesheet.

2 Claims, 2 Drawing Sheets

1
2
3
4
5
6
7
8
9
10
11
12
13
14
15
16
17
18
19
20
51
52

SEALING ARRANGEMENT FOR INTERNAL TUBESHEET FOR TUBULAR HEAT EXCHANGERS

TECHNICAL FIELD

This invention relates to the threaded channel closure type shell and tube heat exchangers having removable tube bundles. These heat exchangers generally have high pressure on both sides of the tubesheet. They are widely used in critical services in process industries such as Hydrocracking units, Hydrotreating units, Hydrowaxing units, Hydrofining units etc.

BACKGROUND ART

The heat exchanger as per the prior art is explained below with help of following figures.

FIG. 1 shows the sectional view of the threaded channel closure type heat exchanger with internal detail;

FIG. 1*a* shows the enlarged sectional view of spiral element gasket with inner and outer ring or solid metal gasket or metal jacketed gasket;

FIG. 1*b* shows the enlarged sectional view of groove in adjoining components, spiral element gasket without inner or outer rings, but with locating recess.

As indicated in FIG. 1 the heat exchanger comprises a channel header (1) and shell (52); the channel header closure comprises a thread lock ring (2) and a channel cover (3). One of the two heat exchanging fluids passes through the shell (52) while the second fluid passes through the plurality of tubes (5), which are fixed to the tubesheet (4), the shell side and tube side fluids being separated by tubesheet (4). The channel (1) is provided with nozzles (6) for the tube side fluid to enter and exit the heat exchanger. The heat exchanger is preferably provided with two or more tube passes and accordingly, some of the tubes in the first tube pass through which the tube side fluid enters the tube bundle from channel side inlet nozzle, while some tubes are in the final tube pass through which the tube side fluid exits the tube bundle. The tube passes are separated by a plurality of pass partition plates (7) and covers (8). The tubesheet (4) is fixed in the annular shoulder (51) between the shell (52) and the channel (1). The sealing between the shell side and tube side is obtained by means of a gasket. This gasket may be of spiral element type having inner and outer metallic rings or solid metal type or metal jacketed type as shown in FIG. 1*a* or spiral element type without inner/outer ring, but located in a recess made in adjoining components as shown in FIG. 1*b*. An internal channel box assembly (11) is provided in the channel, which, houses the aforesaid partition plates (7) and covers (8). The inner cylindrical portion of the channel box assembly (11) rests against the shoulder provided on the front face of the tubesheet. The outer end of the channel box is attached to an annular ring (12). As the pressure is applied on the annular ring in the axially inward direction, it is transferred to the gasket (9)/(10) through the channel box (11) and compression of the gasket seals the joint between tube sheet (4) and shell (51). The annular ring is pressurized inwards by two different means as follows. Internal bolts (13) are provided on internal flange (14) and the internal flange (14) is further backed by a split ring (15). Thus when the internal bolts (13) are tightened they press on the annular ring which transmits the load on the gasket (9)/(10) for sealing as already explained above. The effectiveness of this sealing can be tested, by pressurizing the shell side before fitting the channel cover (3) and the threaded lock ring (2) in position. Secondly the push bolts/rods (17) provided on the channel cover (3), when tightened press the channel box (11) through annular ring (12) via inner compression ring (18), diaphragm (19) and internal sleeve (20). This facilitates the loading of the gasketed joint in operation.

THE DEFICIENCIES OF THE PRIOR ART

The prior art as described has its inherent drawbacks and deficiencies; these are described as follows. The heat exchangers handle hot fluids at high temperatures (typically 200° C. to 500° C.) and being assembled with different parts made of different materials having different coefficients of thermal expansion, they are prone to generate high thermal stresses in the parts unless the differential thermal expansion of these parts is properly absorbed or compensated. This can result not only in damaging of the parts but also can lead to disastrous accidents, while working under high pressure (typically 50 kg/cm$^2$ to 250 kg/cm$^2$) as in case of the heat exchangers under consideration. The part or means provided in the prior art is the gasket with very limited compressibility; typical spiral element gasket with metallic rings or solid flat metal or jacketed type gasket or spiral element gasket located in recess made in adjoining components being used. These gaskets are prone to above mentioned failures. Trials have been made in prior art with provision of a sacrificial ring (16) between the annular plate (12) and internal push bolts (13), however without success.

In prior art heat exchangers, generous diametric clearance is uniformly provided between the inside diameter of the channel header (1) and the out side diameter of the tubesheet (4) to facilitate easy travel of tube sheet (4) in the channel (1). Due to self weight, the tubesheet has a tendency to settle down at the bottom of the channel during assembly or disassembly. Consequently the tubesheet (4) and the gasket (9) or 1(0) may not remain concentric with annular shoulder in the channel. It is also not feasible to ascertain this alignment beforehand and may require pulling out the tubesheet with bundle and reassembling it.

Prior art channel box (11) consists of a cylindrical barrel attached to an annular ring (12) towards the push bolts. The load is transferred in this case through bending forces on the annular ring. It is also very difficult to insert the channel box inside the channel owing to its cylindrical shape, which has a small diametric clearance between channel inner diameter and channel box outer diameter.

In the prior art heat exchanger it can be seen that, internal push bolts (13) are engaged in threaded holes in a ring (14), which is backed by a full faced split ring (15), which is engaged in a groove made in inside surface of channel. The reaction force generated by push bolts (13) subjects the split ring to combined load of shearing and bending. Due to bending action of split ring, transmission of the load during tightening the push bolts is inefficient and can cause damage to internal flange, push bolts and annular ring.

DISCLOSURE OF INVENTION

Keeping in view the above drawbacks of the prior art, the objective of the present invention is to eliminate or reduce the same.

Hence the objective of this invention is to provide a sealing member and arrangement that can absorb the differential thermal expansion of the component parts, hence eliminate the dangerous thermal stresses; at the same time providing efficient sealing.

Another objective of the present invention is to prevent misalignment between the tube sheet, gasket and seating area of annular shoulder in the channel header, for ensuring proper seating of the gasket.

Another objective of the present invention is to achieve efficient transmission of the load generated by internal and external push bolts by changing from bending loads to either direct shear or direct compressive load.

Yet another objective of the present invention is to simplify the assembly by making the insertion of channel box easy for insertion in to the channel header.

The present invention makes use of the spiral element gasket without any metallic rings (21) and without any locating groove made on the shoulder (51) or in the tubesheet. Such gaskets have inherent resilient characteristics, which can undergo incremental compression through the influence of differential thermal expansion. Absence of locating grooves permits unrestricted compressibility of gasket without creating metal to metal contact. Resilient nature of the gasket also ensures proper sealing of the joint.

Inside diameter of the channel for a short distance from the shoulder (51) shown at (101) in FIG. 2 is provided with reduced clearance to achieve a close running or locating fit between tubesheet and channel while normal clearance provided in the balance portion of the channel. This ensures easy insertion of the tubesheet yet ensuring the concentricity and alignment of the tubesheet with gasket and annular shoulder in the channel as the tubesheet reaches its final position in the assembly.

The channel box diameter at the inner face is kept the same as before, however at the outer end the circular face of the channel box is aligned with the push bolts (13). Due to this substantial length of the outer diameter of the channel box gets cleared off the inner diameter of the channel tendering the assembly easy. At the same time load transmitting part of the channel box comes under direct compression while transmitting the load also eliminating bending load on the annular ring (12). Additionally provision of gussets (23) is made to distribute the load uniformly and directly. For push bolts (13) the internal flange (24) is provided which takes only bending load while the split ring (25) is loaded only in shear making the assembly much stronger for sustaining the loads. Threads in the internal flange reach up to the outer face (towards head of the push bolts) to reduce/eliminate bending of pushbolts during tightening.

STATEMENT OF INVENTION

Sealing arrangement for internal tubesheet for tubular heat exchangers comprising, a gasket (21) fitted between shoulder (51) and tubesheet (4), the gasket (21) being made of spiral wound construction but without any metallic rings in the same and without any locating grooves in adjoining parts; on the outer side of the tubesheet, channel box (22) being provided with its inner face resting on the shoulder provided on outer diameter of the tubesheet (4) while the outer face of the channel box (22) being reduced in diameter and arranged to align with the centerline of the push bolts (13); the outer face of the channel box resting against annular ring (12) and push bolts (13) being provided in the threaded holes in the internal flange (24); the push bolts (13) when tightened loading the annular ring (12) from its outer side in turn loading the gasketed joint through channel box (22) and tubesheet (4); the reaction to this load in outward direction being taken by the split shear ring (25); gussets (23) being provided between channel box wall and the annular ring (12); tightening of the set of push bolts (17) load the annular ring (12) through internal compression ring (18), diaphragm (19), internal sleeve (20) and the load on annular ring (12) getting transmitted to channel box (22) through gussets (23) and ultimately the tubesheet (4); for small length (i.e. about 25 mm to 250 mm)[1] inner diameter of channel (101) provided with reduced clearance to achieve a close running fit with tubesheet followed by a conical portion (102), further portion being with a normal clearance.

The present invention "Sealing arrangement for internal tubesheet for tubular heat exchangers" is now described below with help of above figure.

The foregoing objects of the invention are accomplished and the problems and shortcomings associated with prior art techniques and approaches are overcome by the present invention as described bellow in the preferred embodiment.

This invention is illustrated in the accompanying drawings, through out which like reference letters indicate corresponding parts in the various figures.

Figures 1, 1A, 1B:
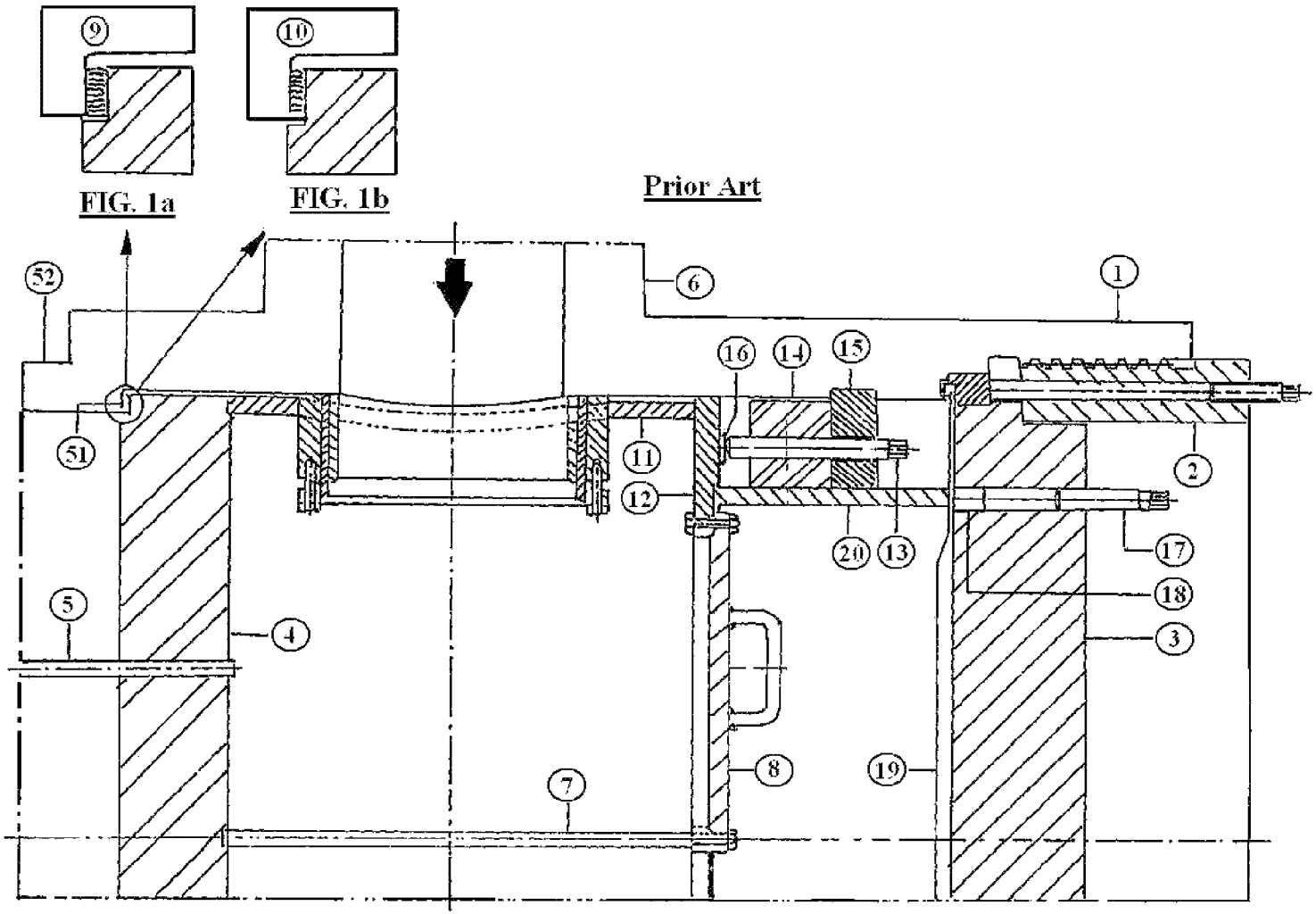
Prior Art FIG. 1
FIG. 1 shows the sectional view of the threaded channel closure type heat exchanger with internal detail.
FIG. 1*a* shows the enlarged sectional view of spiral element gasket with inner and outer ring or solid metal gasket or metal jacketed gasket.
FIG. 1*b* shows the enlarged sectional view of groove in adjoining components, spiral element gasket without inner or outer rings, but with locating recess.
Figure 2:
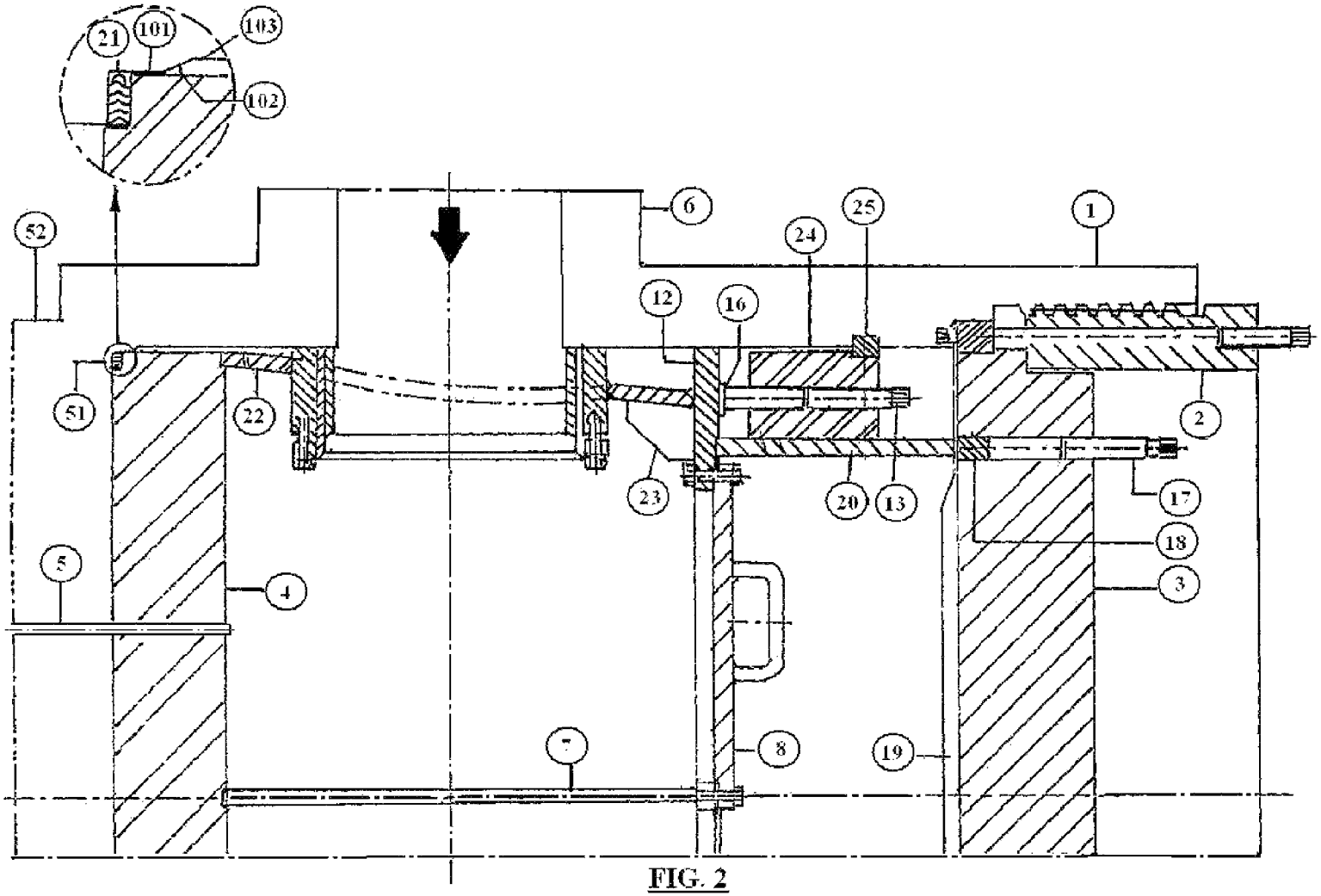
FIG. 2 shows the sectional view of the present invention.

With reference to FIG. 2 the heat exchanger comprises a shell (52) and channel (1). It can be seen that, the shell and channel are separated by the shoulder (51) and the tubesheet (4), which rests on it, with gasket (21) in between. Plurality of tubes (5) is fitted in the tubesheet and projects inside the shell cavity. Right hand side cavity of the tubesheet is the channel side (1). The gasket (21) is made of spiral wound construction but without any metallic rings in it offering high compressibility and without any locating groove in the adjoining components that can restrict the compressibility of gasket. On the outer side of the tubesheet (4) channel box (22) is provided. The channel box (22) has its inner face resting on the shoulder provided at the outer diameter of the tubesheet (4). While the outer face of the channel box (22) is reduced in diameter and arranged to align with the centerline of the push bolts (13). It should be noted that the channel box in general can assume any shape between the two end faces, however a conical shape is preferable for the ease of manufacturing. Actually the outer face of the channel box is attached to the annular ring (12). Push bolts (13) are provided in the threaded holes in the internal flange (24), which when tightened load the annular ring (12) from its outer side, in turn loading the channel box (22), tubesheet (4) and through this the gasketed joint to make it leak tight. Total reaction to this load in the outward direction is taken by the split shear ring (25). Gussets (23) are provided between the channel box wall and the annular ring so as to distribute the load evenly from the annular ring to the channel box, which is caused by tightening of another set of the push bolts (17) provided in the channel cover (3). The load from push bolt (17) is transferred to internal sleeve (20) through internal compression ring (18) and diaphragm (19). Internal sleeve (20) transfers this load ultimately to the gasketed joint through annular ring (12) with gussets (23), channel box (22) and tubesheet (4). Channel cover (3) is held in position by thread lock ring (2). This arrangement changes the nature of loading on the components from bending to direct compressive or shear loads thus ensuring high strength. Secondly, the shell inner diameter for a small length (approximately 25 mm to 250 mm) from the shoulder (51) as shown at (101) is provided with a reduced diametric clearance so as to have a close running or location fit with the tube sheet outer diameter. This being followed by a conical portion (102) subsequently followed by a diameter with normal diametric clearance (103), so as to make the insertion of tube sheet easy, at the same time locating the tubesheet concentric and aligned in its final assembled position.

Numerals (7) and (8) show the partitions and covers respectively which form the compartments in the channel box to separate the incoming and out going fluid or the fluids pertaining to multiple number of passes in case of multipass heat exchanger.

The foregoing objects of the invention are accomplished and the problems and shortcomings associated with prior art techniques and approaches are overcome by the present invention described in the present embodiment.

Detailed descriptions of the preferred embodiment are provided herein; however, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or matter.

The embodiments of the invention as described above and the methods disclosed herein will suggest further modification and alterations to those skilled in the art. Such further modifications and alterations may be made without departing from the spirit and scope of the invention; which is defined by the scope of the following claims.

We claim:

1. A sealing arrangement for an internal tubesheet of a tubular heat exchanger, the tubular heat exchanger having a channel and a shoulder in which a ledge of the tubesheet is fitted, comprising:

a gasket fitted between the shoulder and the tubesheet, the gasket being made of spiral wound construction but without any metallic rings on the gasket, and both the shoulder and tubesheet being without a locating groove;

a channel box on an outer side of the tubesheet, the channel box being provided with an inner face resting on the ledge of the tubesheet and an outer face of the channel box being reduced in diameter and arranged to align with a centerline of push bolts, the outer face of the channel box attached to an annular ring, and the push bolts being provided in threaded holes;

the push bolts when tightened load the annular ring and in turn load the gasket through the channel box and the tubesheet, the reaction to this load in an outward direction being taken by a split shear ring essentially by the action of shear stress; and a gusset provided between the inner face of the channel box and the annular ring such that the load on the annular ring from the tightening of the push bolts is transmitted to the channel box through the gussets and ultimately to the tubesheet to load the gasket;

wherein the channel is provided with an end portion with an inner diameter that is gradually reduced towards the shoulder to achieve a close running fit with tubesheet.

2. The sealing arrangement as claimed in claim 1, wherein of the inner and outer faces of the channel box are of conical shape for ease of manufacturing within the tubular heat exchanger.

* * * * *